United States Patent [19]

Celette

[11] Patent Number: 4,781,045

[45] Date of Patent: Nov. 1, 1988

[54] VEHICLE CHECKING AND STRAIGHTENING EQUIPMENT WITH INTERCHANGEABLE OPERATING HEADS

[75] Inventor: Germain Celette, Vienne, France

[73] Assignee: Celette S.A., France

[21] Appl. No.: 119,232

[22] Filed: Nov. 5, 1987

Related U.S. Application Data

[63] Continuation of Ser. No. 846,861, Apr. 1, 1986, abandoned.

[51] Int. Cl.[4] ..... B21D 1/12

[52] U.S. Cl. ..... 72/31; 72/457; 72/705; 33/288; 33/608

[58] Field of Search ..... 72/32, 31, 34, 705, 72/457; 248/352, 357; 33/608, 645, 516, 520, 288

[56] References Cited

U.S. PATENT DOCUMENTS

| | | | |
|---|---|---|---|
| 3,920,212 | 11/1975 | Westwood | 248/352 |
| 4,174,623 | 11/1979 | LeGrand | 72/705 |
| 4,242,803 | 1/1981 | Dory | 33/288 |
| 4,477,978 | 10/1984 | Azuma | 33/288 |
| 4,479,305 | 10/1984 | Wendl et al. | 33/288 |
| 4,498,242 | 2/1985 | Celette | 33/180 AT |
| 4,549,359 | 10/1985 | Hense et al. | 33/180 AT |
| 4,557,127 | 12/1985 | Pietrelli | 72/705 |

FOREIGN PATENT DOCUMENTS

| | | | |
|---|---|---|---|
| 2831627 | 2/1979 | Fed. Rep. of Germany | 72/705 |
| 2384229 | 10/1978 | France | 72/705 |
| 2556248 | 6/1985 | France | 72/705 |

OTHER PUBLICATIONS

"Kansas Jack Truck & Trailer Repair Equipment", (Catalog), (pp. 1, 5, 7, 8 & 13), Rec. in P.T.O. on Jan. 12, 1982, 72/705, by Kansas Jack.

*Primary Examiner*—Lowell A. Larson
*Attorney, Agent, or Firm*—Wall and Roehrig

[57] ABSTRACT

A vehicle repair system for locating and defining predetermined points of vehicle components to ensure compliance with the vehicle specifications. The system utilizes a common base for interchangeably receiving any one of a plurality of control heads in order to enable the base portion of the system to be utilized in checking and verifying the position of vehicle components for any or a large number of vehicles. Each of the interchangeable control heads is specifically configured for use with a particular vehicle and for locating a component of that particular vehicle so that each of the specific control heads can be utilized in a standard system base eliminating the necessity of individual bases being formed as an integral portion of the position locating or verifying apparatus. In addition, the checking and verification system may be utilized to effect localized repairs or reforming of the automotive components to effect their correct positioning.

7 Claims, 6 Drawing Sheets

VEHICLE CHECKING AND STRAIGHTENING EQUIPMENT WITH INTERCHANGEABLE OPERATING HEADS

This is a continuation of application Ser. No. 846,861, filed Apr. 1, 1986, now abandoned.

BACKGROUND OF THE INVENTION

This invention relates in general to the straightening and checking of automobile bodies, for example, vehicle bodies which have undergone damage from an accident.

More precisely, the invention relates to interchangeable apparatus for establishing certain specific reference points for repairing such a damaged automobile body, for example, the support points of the upper ends of front shock absorbers of the MacPherson type, and to correcting vehicle damage and bringing such reference points back to the original specifications.

Presently, location of such reference points is effected after the vehicle body has been placed on a support bench, and measuring instruments or the like are fitted to the bench to verify whether coincidence exists between the real position of the checked points, and the theoretical position indicated by the specifications supplied by each vehicle manufacturer.

Those verification operations, however, are not very practical to execute. When a deformation or deviation exists, even a slight one, it is frequently necessary to disassemble some structural support portions of the damaged body in order to be able to check the location of such reference points and to effect localized straightening of the vehicle body with apparatuses designed for that purpose. Thereafter, those structural support portions of the body must again be put back into their previous position in order to check whether the straightening which has been performed is satisfactory. Such operations thus require a long period of time. That is why the present invention has as its purpose to perform such operations more easily, and to effect localized straightening without any need to take apart the fixed structural supports of the body in the area of the deformed part.

In addition, the present invention comprises one or several individual control heads which function to define fixed specific points of a automobile body to be corrected or checked on a control bench, all of which utilize a common base structure. The common base comprises a hollow column secured to or formed with a solid fastening plate. The base includes a fixed guiding sleeve, inside which may be mounted a sliding rod, interchangeable in any base, carrying a control head member having a particular configuration suitable to serve as a fixing support or positioning control of a specific point of an automobile body.

Thus, it is possible to measure the dimensional coordinates of parts of an automobile body on a repair or checking bench by using several of those devices, some of them functioning to hold or fix the damaged automobile body in place on said bench, while the others control or reform the damaged portions. The whole of the devices thus used constitutes a repair installation.

SUMMARY OF THE INVENTION

To that end, the present invention has as its object a device which is suitable to be mounted on a measuring or support bench, and which is constituted by a standard column open over its entire height. The upper end of the standard column carries a fixed guiding sleeve which is adapted to receive a control rod capable of movement within the sleeve, or of being fixed or immobilized in a position wherein its upper end establishes a point in space which must normally be occupied by a part of a vehicle body to be checked or repaired. The column can also function, in cooperation with a control head mounted in the sleeve, as a pushing member to apply a pushing force against the body to produce a localized straightening of that body part, by means of a jack positioned inside the open column and acting against the control head sliding rod.

Thus, the present device makes it possible to utilize a standard base with interchangeable control heads to perform the desired dimensional checking operations, and at the same time to perform localized straightening of the body. In this respect, it is very obvious that said device can be used only for straightenings of limited deformations. In case of major deformations, it is necessary to use the usual straightening apparatuses or to replace the corresponding part of the body. However, in numerous cases, many deformations can be corrected with the device according to the present invention.

DESCRIPTION OF THE DRAWINGS

The different characteristics and advantages of the device will appear in the course of the following description of one example of said device. That description is given with reference to the attached drawing, attached only as an illustrated and in which.

DESCRIPTION OF THE PREFERRED EMBODIMENT

Figure 1:
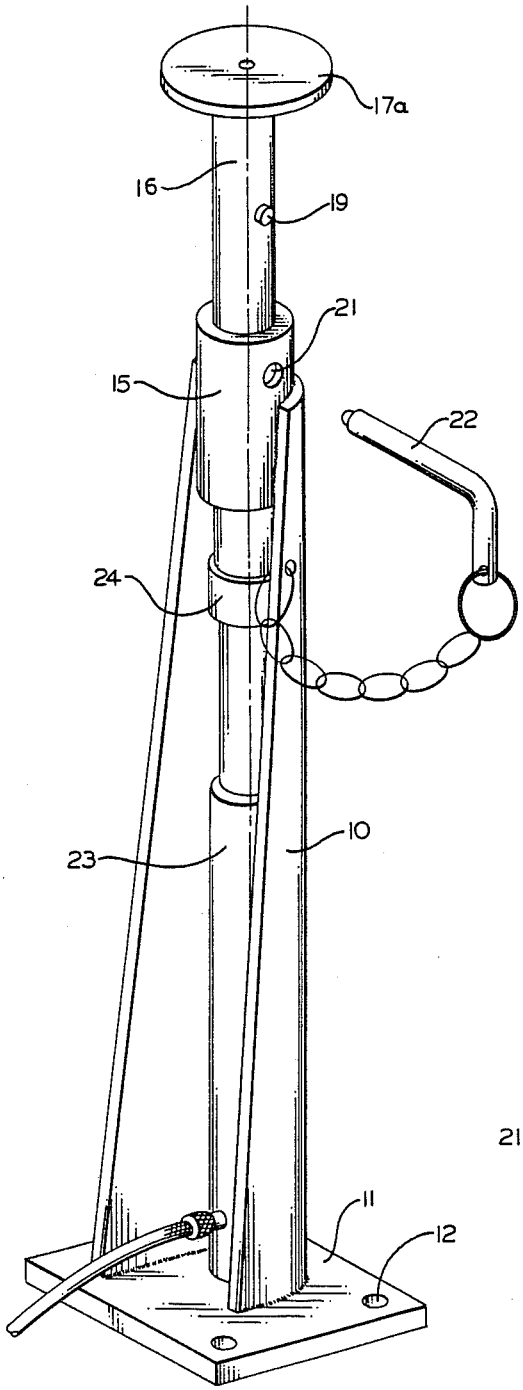
FIG. 1 is a perspective view of a control and straightening device according to the present invention, which is illustrated incorporating a pushing jack inside the column of said device.

In the example represented in FIGS. 1 to 4, the device according to the present invention is meant to ensure the control or fixed positioning and localized straightening of the support for the upper end of a shock absorber 1 of the MacPherson type, which equips one of the front wheels 2 of an automobile. As represented in FIG. 5, the upper end of such a shock absorber is affixed through a small cup 3, into an opening 4 made in the internal wall 5 of the respective front fender of the corresponding body, C.

In order to perform such operations, the automobile body is secured upon a control or checking bench 6, by means of several securing attachments or mounts adapted to the various types of vehicles to be checked. Those attachments or mounts each comprise a lower plate 8 meant to be affixed to one of the longitudinals or stringers 9 of the control bench being used, for example a bench such as the one described in French Pat. No. 2,423.748 or U.S. Pat. No. 4,242,803. In order to check the position of the attachment support of the upper end of the front shock absorbers of the MacPherson type, however, the corresponding wheels 2 of the vehicle must be taken down before the body is set into place on the bench 6.

Figure 3:
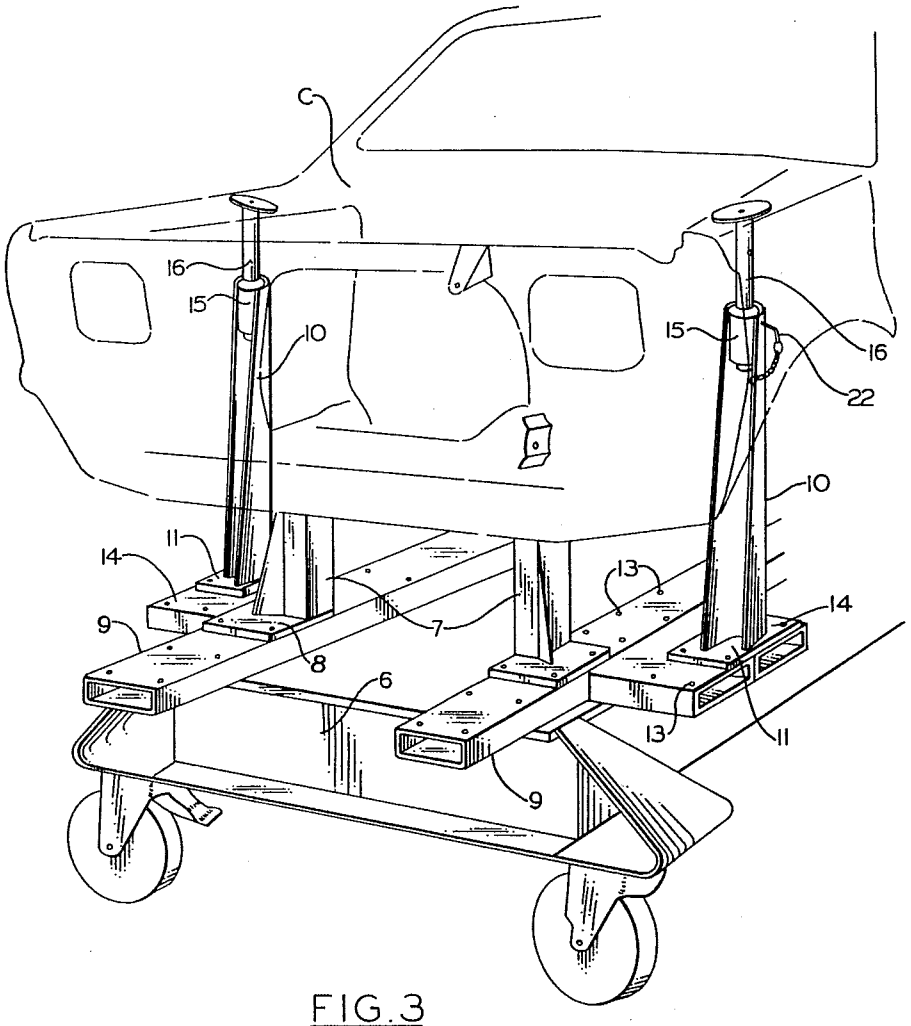
FIG. 3 is a partial view, in perspective, of a measuring or repair bench on which two devices according to the invention have been fitted.

The device according to the present invention is constituted by a column 10, open over its entire height, the lower end of which comprises an attachment plate 11 fitted with holes 12 spaced according to the same spacing module as the holes 13 provided for on the stringers 9 of control bench 6, as well as on the lateral appendages 14 provided for at the fore end of those stringers. Advantageously, each column 10 comprises a piece of metal rolled in the form of a trough, the lateral walls of which have a width which tapers upwardly as represented in FIGS. 1 and 3.

At its upper end, column 10 carries a guiding sleeve 15 secured inside that end, and fixed to the latter by welding. In said sleeve there is received a control rod 16 capable of sliding inside it. However, there are preformed positioning means, not shown, which prevent twisting or rotation of the rod inside guiding sleeve 15.

Figure 2:
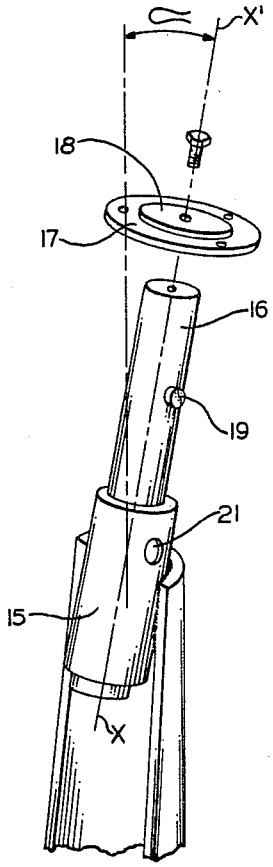
FIG. 2 is a partial view, in perspective, representing the upper end of the device shown in FIG. 1 without incorporating the pushing jack, such as used in a form in which it is simply to perform a measurement verification or establishing operation.

Indeed, rod 16 is set with a precise angular orientation to ensure the correct position in space of the support or attachment point of the upper end of a shock absorber 1 of the MacPherson type, determined by the axis X-X' of the guiding sleeve 15 which forms an angle $\alpha$ relative to the vertical direction. Sleeve 15, therefore, is set in the desired orientation on the upper end of column 10, as illustrated in FIG. 2.

At its upper end, rod 16 carried a disc 17 fitted, at its center, with a projecting washer 18, used for centering, which is meant to be engaged into opening 4 provided for in part 5 of the automobile body for the fixation of the upper end of a shock absorber 1 of the MacPherson type.

In its resting or retracted position, rod 16 is located in a low position which is determined by a lug piece 19 carried by the rod 16 and which is supported on the upper edge of sleeve 15. However, in order to accomplish the proper location point, the rod 16 must be raised, or extended, by sliding to a position at which a transverse boring of the rod 20 is brought into a position coaxially with two diametrically opposed holes 21 of the guiding sleeve 15. A pin 22 then makes it possible to immobilize or fix rod 16 in that position at which the upper centering washer 18 will be very accurately engaged in opening 4 of the corresponding part 5 of the automobile body, while disc 17 is supported against the internal edges of that same opening, as represented in FIG. 4.

If such a coincidence cannot be achieved, that means that the corresponding part of the body has been deformed, and no longer corresponds to the specifications indicated by the manufacturer of the vehicle. When deformation of limited deviation from the standard exists, that part of the body can be straightened by the device without the need to remove the securing attachments from the body.

Figure 4:
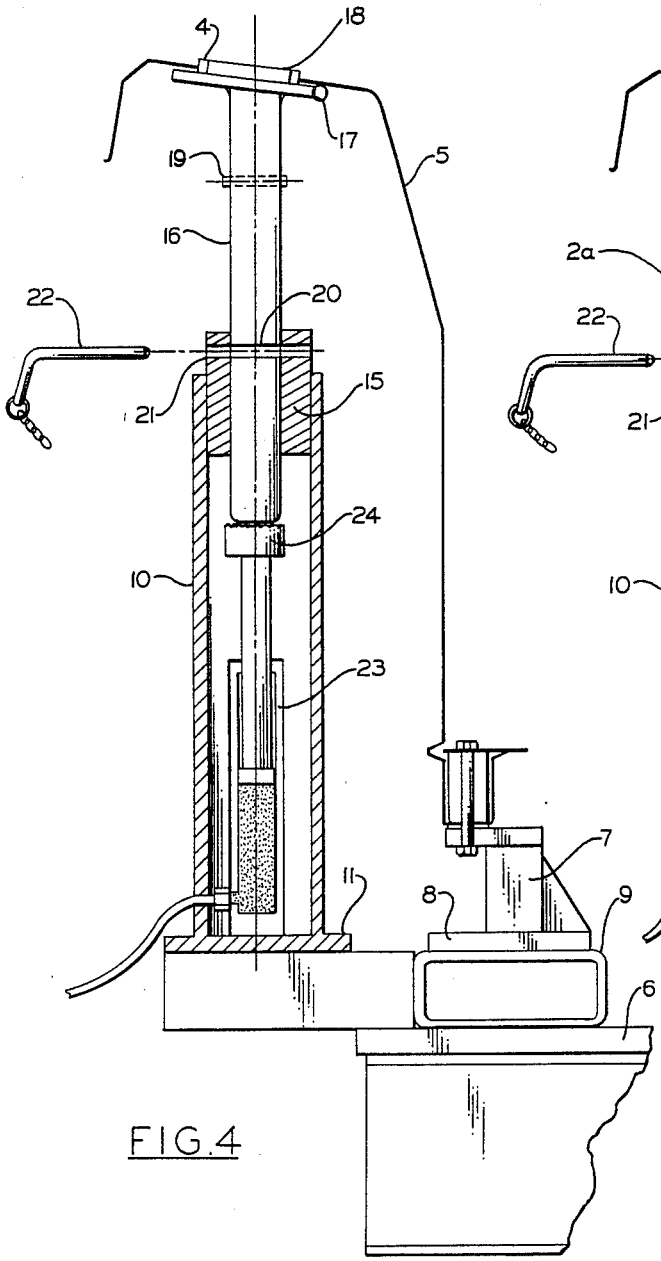
FIG. 4 is a vertical section view of one of the devices illustrated in FIG. 3 and of the corresponding part of an automobile body fixed on such a bench.
Figure 9:
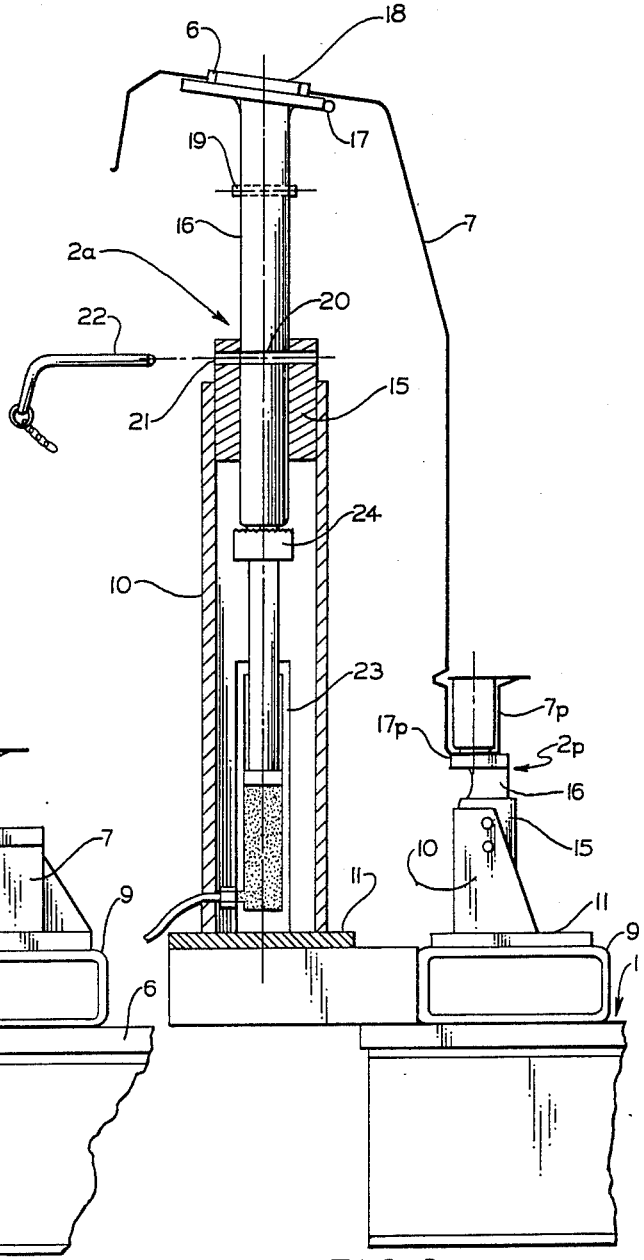
FIG. 9 is a view, similar to FIG. 4, partly in section and partly elevated, of two of the fixation and reforming devices provided in the front of the vehicle.
Figure 5:
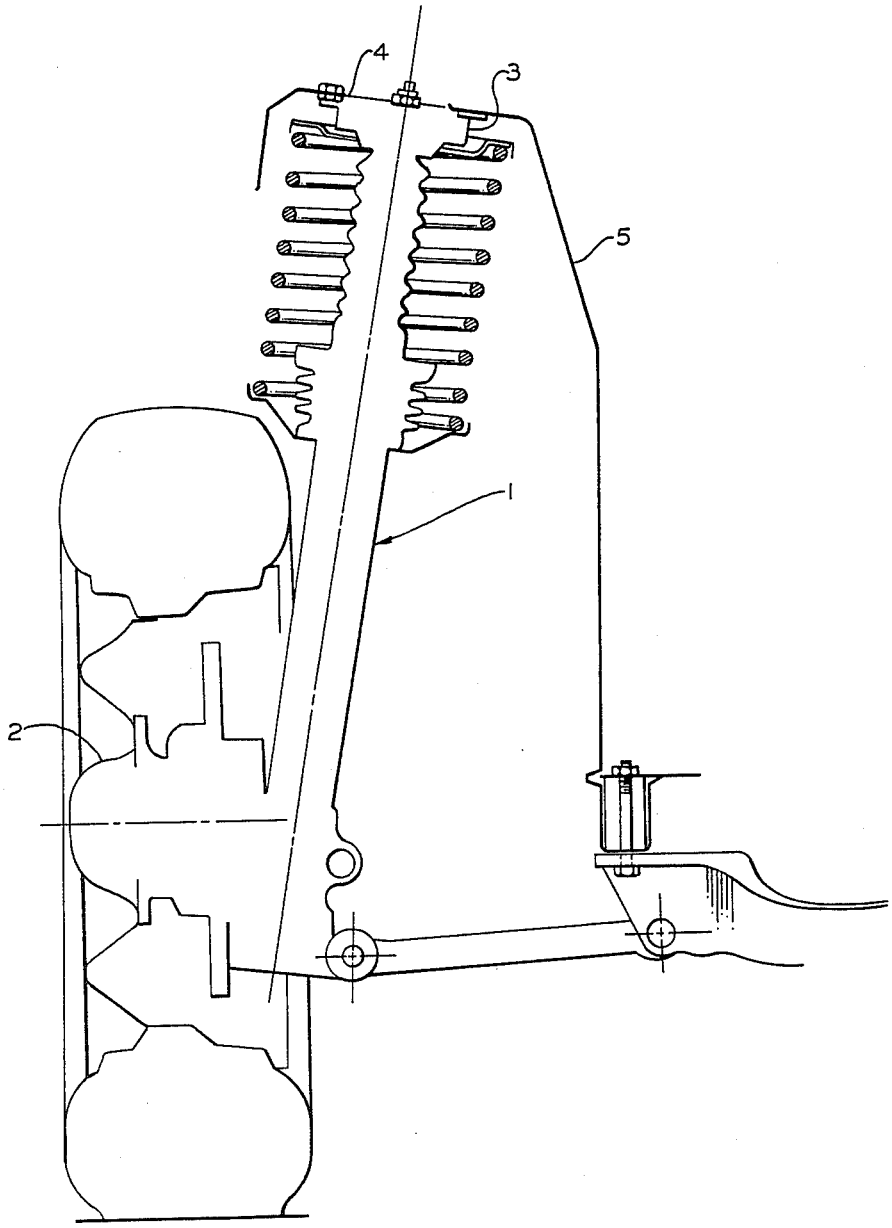
FIG. 5 is a section view of the corresponding part of that same automobile body prior to the removal of the respective front wheel and the securing of the vehicle body to the bench.

Indeed, because column 10 is open over its entire height, a hydraulic pushing jack 23 can be placed inside as illustrated in FIGS. 1 and 4, so that the head 24 of the jack will contact and act on rod 16. The latter then may serve as a pushing member applying a force against the internal face of the corresponding part 5 of the body. In such a case, disc 17 and centering washer 18 may be replaced by another disc **17*a*** capable of serving as a support member and which is free from any centering washer at its upper end.

In this manner it is, therefore, possible to proceed very easily and rapidly to the localized straightening of the corresponding part of the body. Afterwards, the device may again be used to check or verify the performed straightening, and to check whether the location of opening 4 now corresponds to the specifications to which the body is to be repaired.

Of course, as already indicated, the device can be used only for straightening operations which correspond to deformations of limited extent or limited deviation from the original standard. However, it is frequently that one encounters such deformations. That is why in numerous cases the device will be sufficient to perform such corrections, and will prevent the need to resort to the use of the usual body straightening apparatuses. Such a feature results in an extremely important saving in time, and makes it unnecessary to disassemble the body supports permitting the straightening operation to be performed immediately with the same device.

Taking into account the specification differences among the various automobile bodies to be repaired, it is necessary to make use of different control heads for rods 16, which corresponds to each particular application. It is possible, therefore, to fit into the upper guiding sleeve 15 of a standard control device, rods 16 fitted with different types of upper discs 17 which are themselves oriented in various ways to correspond to the specifications of each type of vehicle to be checked. Of course, the high or extended position of each one of control rods 16 also can vary as a function of the height at which location 4 for the fixation of a shock absorber 1 of the MacPherson type must be located.

Because of its design and of its advantages, the device is especially well suited to confirm or establish and perform localized straightening, if required, of the attachment point for the upper end of a front shock absorber of the MacPherson type. The invention or device, however, can also be used for locating and establishing, and localized straightening, of other internal points of an automobile body, as long as the vertical height is modified accordingly.

Figure 6:
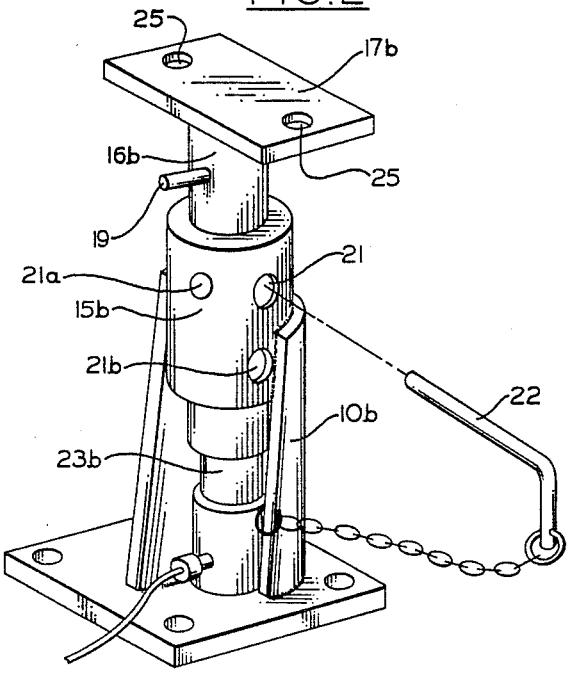
FIG. 6 is a perspective view of a variation of the device according to the invention.

Thus, FIG. 6 represents a form of the invention in which column **10*b* of the corresponding device is very short, to establish a fixed location for another given point of a car body. The characteristics of that device, however, remain the same as before. Indeed, the upper end of that column carries a guiding sleeve 15***b*, inside which there slides a control rod 16*b* capable of receiving a support element which, in the example represented, consists of a rectangular plate 17*b* fitted with marking holes 25. Of course, there are also provided means which determine the position in height of rod 16*b*. Moreover, those means may be the same ones as those previously described, that is to say holes meant to be made to correspond to receive an immobilizing pin 22. Guiding sleeve 15*b*, however, advantageously may include two holes 21 and 21*b*, instead of a single one, to make possible two different positions for setting the height of rod 16*b*. Just as in the previously describe embodiment, column 10*b* is open over its entire height. In that way, it is possible to position a jack 23*b* inside the column to apply a localized straightening force on the corresponding part of a car body.

In order to locate or check a number of specific points of an automobile body, or to apply a reforming force, there may be provided a set of three open columns, such as columns 10 and 10*b* which have been described above, presenting different heights and the upper sleeve of which, 15 or 15*b*, is capable of receiving various control and pushing rods 16 or 16*b*, which themselves have various heights, and are fitted with support washers or shoes 17, 17*b* presenting various orientations, depending on the nature of the points to be checked or at which a correcting force is to be applied. Instead of two holes 21, 21*b*, column 10*b* may comprise two angularly shifted holes (two holes 21 and 21*a*, for example) shifted by 90° so as to permit a corresponding modification of the slant of support plate or shoe 17*b* carried by rod 16*b*.

Figure 7:
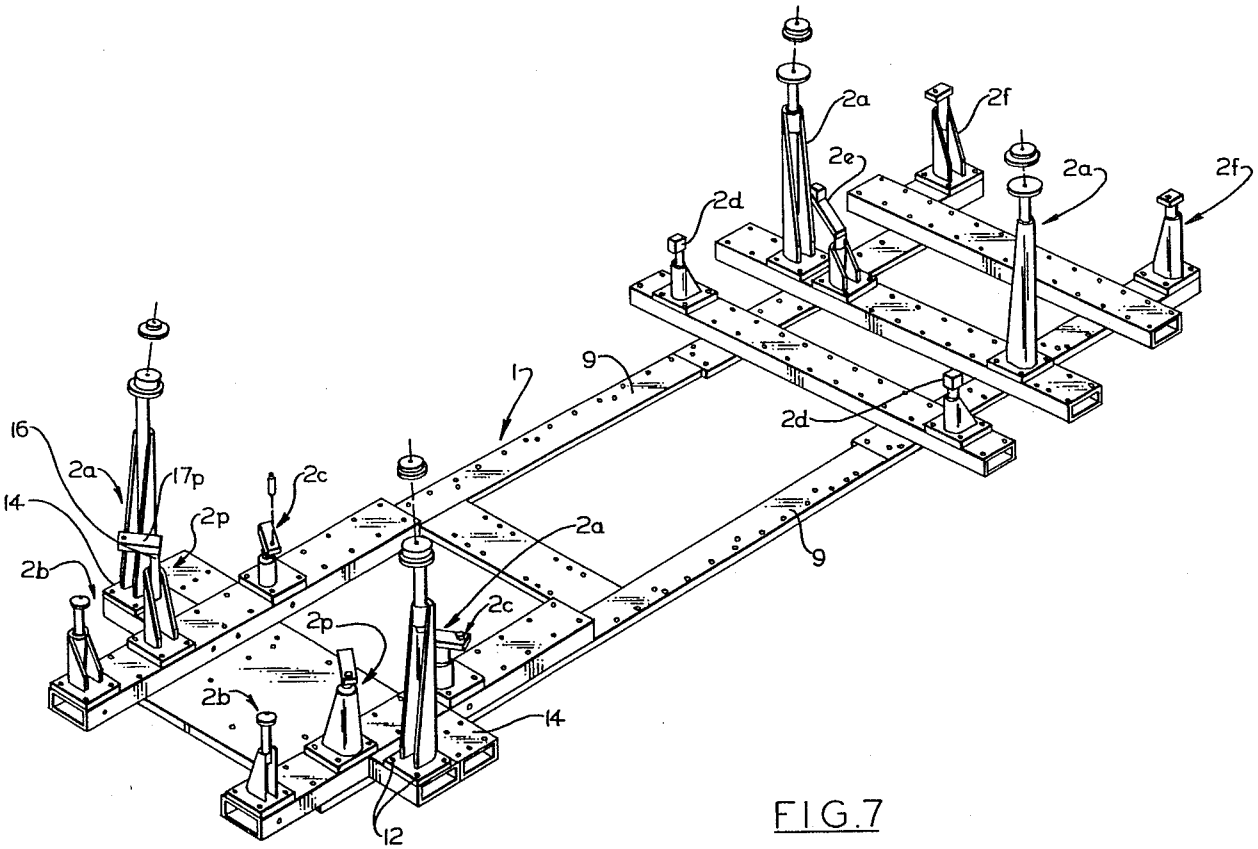
FIG. 7 is a perspective view of a repair or measuring bench equipped with a plurality of such devices.
Figure 12:
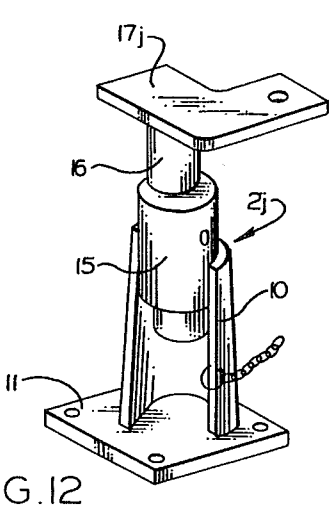
FIGS. 10 to 15 represent specific control or securing devices wherein individually configured heads are utilized in a common column base.
Figure 11:
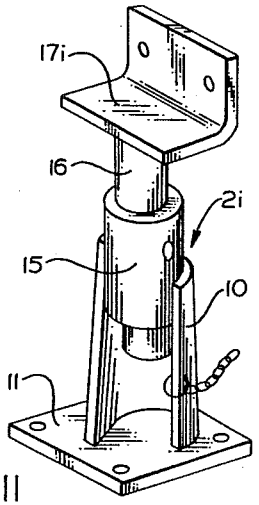
Figure 10:
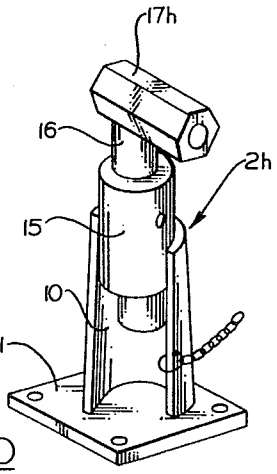
Figure 15:
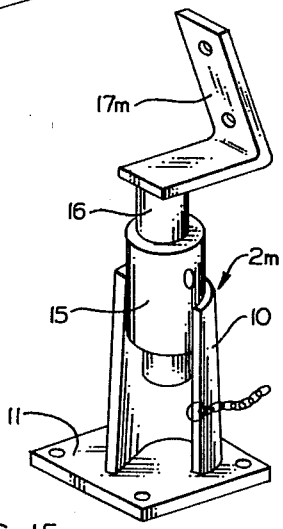
Figure 14:
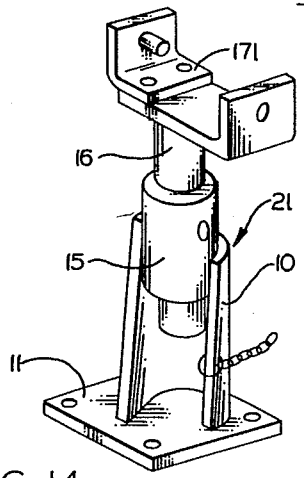
Figure 13:
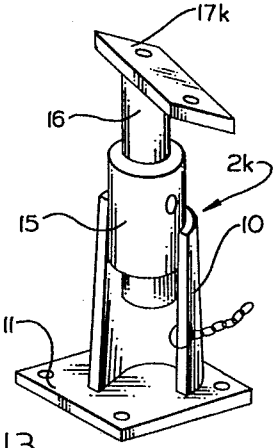

FIG. 7 represents an automobile body checking or repair bench 1 which is equipped with a repair or checking installation comprising several measurement checking and fixation securing devices according to the invention, which are designated by the general references 2*a*, 2*b*, 2*c*, 2*d*, 2*e*, 2*f* all of which have bases 10 of a similar design, and which are meant to establish or define different spatial points for a given vehicle.

The control devices 2*a* are of the type of the one illustrated in the drawings with each one meant to ensure the correct positioning, and localized straightening of the attachment point such as the upper end of a shock absorber of the MacPherson type equipped to one of the front wheels of an automobile.

Each one of the control devices 2*a* is constituted by a column 10 open over its entire height, the lower end of which comprises or is fixed to a plate 11 formed with holes 12 spaced according to the same spacing module as holes 13 (FIG. 3) provided for on the stringers or longitudinal members 9 for the control or checking bench 1, as well as on the lateral appendages 14 provided at the front end of those stringers.

The other devices 2*b*, 2*c*, 2*d*, 2*e*, and 2*f*, represented in FIG. 7, also are designed to ensure the correct location in space of positions corresponding to specific points of an automobile body, and may also be used for securing the vehicle to the corresponding bench 1, at those various points.

All of these devices are of the same general design as devices 2*a*, described before, except for the configuration of the individual head portions. Indeed, each one of the devices is constituted by a hollow column 10, open over its entire height, and the lower end of which is affixed to a plate 11. The plate 11 is formed with holes 12 having the same spacing module as holes 13 and 14, while the upper end of the column 10 includes a sleeve 15 inside which there slides a rod 16. These devices may be used both for dimension checking and for a localized straightening operation. In this latter case, a retractable jack, such as jack 23, is placed inside column 10 of the corresponding device to act against the bottom of rod 16.

All of the devices illustrated in FIGS. 10–15 differ from devices 2*a* only by their height and by the configuration of the control head attached to the upper end of their sliding rod 16. Indeed, instead of a support shoe 17 carrying a centering washer, as in device 2*a*, control heads of different types are provided dependent upon the particular application and the position of the various points to be located or corrected.

FIGS. 10–15 represent various devices 2*h*, 2*i*, 2*j*, 2*k*, 2*l*, 2*m*, with each of the sliding rods 16 being fitted with specific control heads 17*h*, 17*i*, 17*k*, 17*l*, 17*m* of different types.

Figure 8:
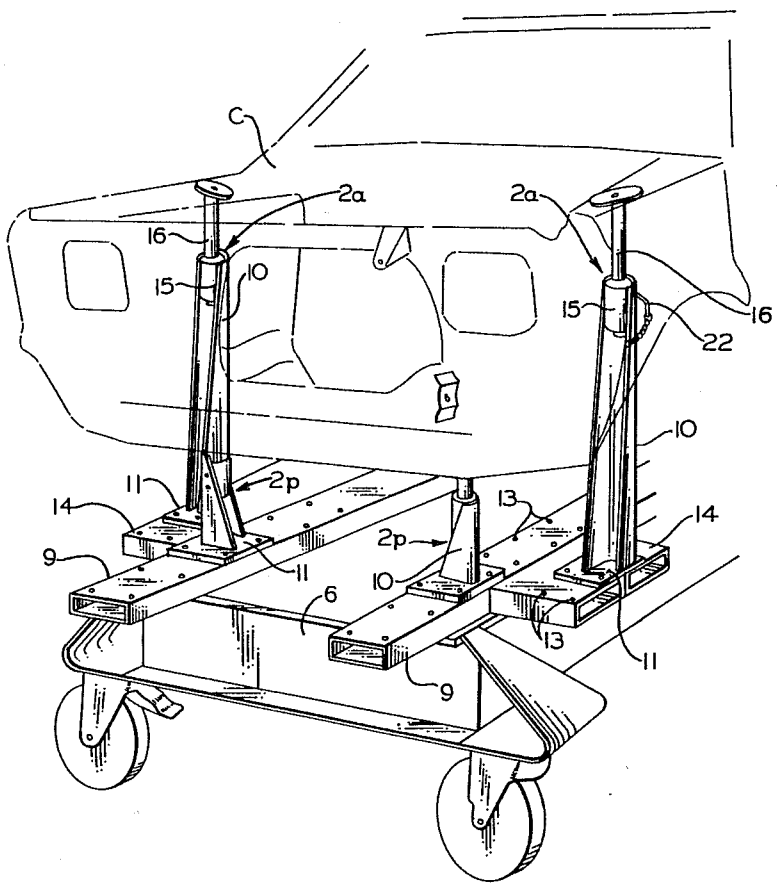
FIG. 8 is a perspective view, similar to FIG. 2 of the repair and securing devices provided for at the front end of an automobile body to secure the body to the bench.

As previously discussed, the automobile body to be checked is first fixed to bench 1 by means of a certain number of attachment devices which are of the same type as the devices designed for the control operations themselves. The securing devices 2*p*, best shown in FIG. 8, are specific for the particular type of vehicle to be checked, and function to prevent possible deformation of the automobile body being checked. Each one of those devices 2*p* constitutes a column 10 open over its entire height, with the lower end comprising a plate 11 which allows the device to be fixed to the stringers of the control bench 1. The columns 10 each carries a rod 16, mounted in a sleeve 15, and which carries a head 17*p* suitable to receive a complementary element of the automobile body, which element may be fixed to the head 17*p* by means of one or several bolts.

By using a sufficient number of attachment devices of that type, which are judiciously distributed, it is possible to fixedly secure the automobile body on the repair or measuring bench to make it possible to perform with the control devices. For example, the fixation of the automobile body may be completed through the use of securing clamps for fastening to the body base. Thus, during the exertion of strong pulling forces due to the operation of the corresponding jacks, the stresses are distributed over the various attaching devices, and over those clamps or pincers connected to the vehicle, with lesser dangers of unintentional deformation of the under body and of the fixation devices.

The fact that portions of the location or positioning devices and the fixation devices are identical presents the advantages that the fabrication cost of those devices is appreciably decreased when compared to the fabrication cost of integral individual mounting structure for prior control devices which were previously used for a control according to the so-called "positive" system.

The commonality of the device base, the plate 11, the open riser or column 10, the sleeve 15, and the construction of those devices with open columns 10 of various heights, present the advantages of being able to use a universal base for all types of automobiles. In this manner, a basic base module can be sued for all types of vehicles. Rods 16, with their specific head configurations 17*h*, 17*i*, 17*k*, 17*l*, 17*m* (FIGS. 10–15) may be interchangeably used in a common base, and thereby present the advantage of a considerably lower fabrication cost, as compared to a complete base formed as an integral unit with a control head—one unified assembly—to be connected between the holes of the cross pieces and the position to be checked under the vehicle. In the present invention, rods 16 are commonly sized and only their specific heads are particular for a given type of vehicle, so that they may use a common base connected to the measuring or repair bench.

What is claimed is:

1. In a vehicle repair system for verifying the correct location of components of a damaged vehicle wherein the vehicle is secured to a checking bench having a plurality of spaced fastening holes formed therein for mounting locating devices for verifying the correct position of vehicle components during a repair process, the improvement comprising a common base member having a mounting plate containing a plurality of spaced fastening holes by which said base member may be secured to fastening holes on the checking bench and a column member secured to the mounting plate and extending outwardly therefrom, a sleeve member secured in said column member having an opening passing axially therethrough and an indexing bore passing radially therethrough, a plurality of interchangeable heads for engaging a vehicle, each head having a common control rod that is receivable within the opening in said sleeve whereby the heads can be selectively changed in said column to carry out various functions, each interchangeable head having a pin receiving bore extending through the control rod at a predetermined location for orientating the head relative to the sleeve so that upon the coaxial alignment of the indexing bore in the sleeve with the pin receiving bore, in a head, the head will be in a predetermined position relative to a vehicle secured to the checking bench, said column member being formed with a recess for receiving therein a removable force applying cylinder that is actuable to apply a correcting force to the vehicle through a selected one of said interchangeable heads, and securing pin means for insertion through said coaxially aligned bores to fix said interchangeable heads in said base member relative to the checking bench.

2. The repair system of claim 1 that includes a plurality of common base members fastened at preselected positions upon said checking bench.

3. The repair system of claim 1 wherein said sleeve contains a cylindrical opening passing axially therethrough and each interchangeable head includes a circular rod that is slidably received within said opening.

4. In a vehicle repair system for correcting and verifying the position of components of a damaged vehicle wherein the vehicle is secured to a checking bench having a plurality of spaced fastening holes, the improvement comprising a common base that includes a mounting plate and a column member secured to said mounting plate which extends outwardly from the mounting plate and terminates in a distal end, said mounting plate having a plurality of mounting holes by which the common base may be secured through the fastening holes to the checking bench at a desired position in accordance with a vehicle secured upon said checking bench, a sleeve member secured in the distal end of the column member, said sleeve having an opening passing axially therethrough and an indexing bore passing radially therethrough, a first checking head having a common coupling rod that is receivable within the opening formed in said sleeve member, said checking head having a pin receiving bore formed in the common rod at a predetermined location for orienting said checking head having a pin receiving bore formed in the common rod at a predetermined location for orienting said checking head in a predetermined position relative to the vehicle when the pin receiving bore is coaxially aligned with the indexing bore, an interchangeable clamping head also having a common coupling rod that is receivable within the opening formed in said sleeve member, said clamping head having a pin receiving bore formed in said common rod at a predetermined position relative to the vehicle when the pin receiving bore is coaxially aligned with the indexing bore, and pin means for insertion through said coaxially aligned bores to fix the interchangeable heads in predetermined positions relative to the vehicle secured to the checking bench whereby the common base does not have to be removed from its secured position on the bench when the heads are interchanged.

5. The repair system of claim 4 that further includes an interchangeable reforming head having a common coupling rod that is receivable within the opening formed in said sleeve member, said reforming head having a pin receiving bore formed in the common rod at a predetermined position relative to the vehicle when the pin receiving bore is coaxially aligned with the indexing bore.

6. The repair system of claim 5 that further includes a removable force applying cylinder that is insertable into a recess formed in the column member for applying a correcting force to the vehicle through said reforming head.

7. The body repair system of claim 4 that includes a plurality of common bases fastened to the checking bench.

* * * * *

UNITED STATES PATENT AND TRADEMARK OFFICE

CERTIFICATE OF CORRECTION

PATENT NO. : 4,781,045

DATED : Nov. 1, 1988

INVENTOR(S) : Germain Celette

It is certified that error appears in the above-identified patent and that said Letters Patent is hereby corrected as shown below:

In Claim 4, Column 8, line 21, the phrase "having a pin receiving bore formed in the common rod at a predetermined location for orienting said checking head" is a repeated expression and should be deleted.

Signed and Sealed this

Seventh Day of March, 1989

*Attest:*

DONALD J. QUIGG

*Attesting Officer*

*Commissioner of Patents and Trademarks*